US008007414B2

(12) United States Patent
Riney et al.

(10) Patent No.: US 8,007,414 B2
(45) Date of Patent: Aug. 30, 2011

(54) EXERCISE MACHINE TO TRAIN THE HAMSTRING GROUP OF MUSCLES

(76) Inventors: Dennis P. Riney, Cape Girardeau, MO (US); Brady Joseph Mattingly, Arnold, MO (US)

( * ) Notice: Subject to any disclaimer, the term of this patent is extended or adjusted under 35 U.S.C. 154(b) by 0 days.

(21) Appl. No.: 10/195,804

(22) Filed: Jul. 15, 2002

(65) Prior Publication Data

US 2004/0209745 A1 Oct. 21, 2004

Related U.S. Application Data

(60) Provisional application No. 60/305,505, filed on Jul. 16, 2001.

(51) Int. Cl.
*A63B 21/068* (2006.01)

(52) U.S. Cl. ..... 482/95; 482/97; 482/137; 482/145

(58) Field of Classification Search ..... 482/93–98, 482/137, 138, 140, 141
See application file for complete search history.

(56) References Cited

U.S. PATENT DOCUMENTS 4,226,415 A * 10/1980 Wright ..... 482/113
4,405,128 A 9/1983 Mclaughlin et al.
4,462,252 A * 7/1984 Smidt et al. ..... 73/379.01
4,600,196 A 7/1986 Jones
4,627,619 A 12/1986 Rockwell et al.
4,725,054 A 2/1988 Solow et al.
4,763,897 A 8/1988 Yakata
4,834,396 A 5/1989 Schnell
4,836,536 A 6/1989 Jones
5,070,863 A * 12/1991 McArthur et al. ..... 601/26
5,135,459 A 8/1992 Perry, Jr.
5,256,126 A * 10/1993 Grotstein ..... 482/142
5,300,005 A * 4/1994 Wang ..... 482/142
6,059,701 A 5/2000 George et al.
6,387,024 B1 * 5/2002 Monti et al. ..... 482/142
2001/0053734 A1 * 12/2001 Lapcevic ..... 482/134
2002/0151419 A1 * 10/2002 Barnes et al. ..... 482/142

FOREIGN PATENT DOCUMENTS

WO WO 01/14017 A1 * 3/2001

* cited by examiner

*Primary Examiner* — Jerome W. Donnelly
*Assistant Examiner* — Victor K. Hwang
(74) *Attorney, Agent, or Firm* — Paul M. Denk

(57) ABSTRACT

An exercise machine to train the hamstring group of muscles including a base, said base being formed of frame members, a knee rest provided upon the base, a frame member extending rearwardly supporting a cross support, whereby the exerciser rests upon the kneel rest and places his/her ankles under the ankle support, a vertical framework pivotally mounted to the base, the upper end of the vertical framework including a chest support, while various weights may be attached to the proximate bottom of the vertical framework to regulate the amount of stress exerted upon the user while exercising upon the exercise machine.

13 Claims, 6 Drawing Sheets

EXERCISE MACHINE TO TRAIN THE HAMSTRING GROUP OF MUSCLES

This application claims benefit of priority to provisional application 60/305,505, filed Jul. 16, 2001.

BACKGROUND OF THE INVENTION

This invention relates generally to a device for exercising select muscles of the body, and more specifically pertains to a structured exercising device that can be used in particularly strengthening the hamstring muscles of the athlete, and others, desiring such type training.

Numerous types of exercising devices are currently available upon the market. All one need do is to attend one of these fitness centers, to see the voluminous number of exercising devices available, or watch the late night T.V. and cable, for the various types of isolated exercising devices being promoted for the market.

Numerous patents have issued to others relating to various types of muscular exercising apparatus, as can be seen in the U.S. patent to McLaughlin, et al, U.S. Pat. No. 4,405,428, which discloses such an exercising apparatus and method. The particular device disclosed appears to be more for use in subjecting the torso, and particularly the abdominal muscles, to exercising stress, as can be noted. The device does include a series of rollers, various frameworks, and the like, for use for producing torque that adds tension to the muscles, during an exercise, but the actual physical device, its method of usage, and the results to be obtained therefrom, are quite distinct from this current development.

The patent to Jones, U.S. Pat. No. 4,600,196, shows an exercising device, once again, which appears to place tension upon the muscles of the upper torso, when the exerciser urges forwardly, against its variously arranged pads, and further against the resistance of select springs or cams, while undertaking an exercising cycle. While this device includes a member that provides for its forward pivot, of the upper portion of the body, the exerciser himself/herself appears to be at rest upon a seat, and does not provide that much of a tension that is placed upon the muscles below the waist, during usage of the shown device.

The patent to Rockwell, et al., U.S. Pat. No. 4,627,619, once again, shows an exercising device where the exerciser sits upon a seat, which means that most of the tension produced is to the abdominal muscles, during exercising.

The patent to Solow, et al., U.S. Pat. No. 4,725,054, shows a low inertia counterbalance mechanism. This device is also a complex mechanism, it does appear to have some pivot to its arms, as noted, but since there is an apparent seat involved, the counterbalancing of the weight mechanisms appears to add force to the upper torso, or the upper body mass, of any person secured in this apparatus.

The patent to Yakata, U.S. Pat. No. 4,763,897, shows another exercise machine with an adjustable position bar. The various exercises undertaken, as can be noted in the figures of this device, generally are for providing a tightening of various muscles of the body, and which might even place some tension upon the hamstrings, but the particular mechanism involved, as shown, and its method of usage, is quite distinct and different from the current invention.

The patent to Schnell, U.S. Pat. No. 4,834,396, shows a multi-exerciser device, but once again, since the user will either sit or rest upon the shown support member, it is unlikely that the generation of tensioning in the various muscles in the area of the hamstring group, will not be subjected to much force. In addition, the structure of this device is very distinct from the current invention.

The patent to Jones, U.S. Pat. No. 4,836,536, shows an apparatus for exercising muscles of the lower trunk of the body, but once again, these exercises are generated while the user is in a seated position, and it appears that primarily it is the abdominal muscles that may be stressed when the exerciser undertakes the type of positions for exercising as shown in this device.

The patent to Perry, Jr., U.S. Pat. No. 5,135,459, shows an abductor contracting exercise apparatus and method. This device appears to be more related to the suspension of the user in an inverted position, rather than to stress and exercise the hamstring group of the muscles per se. Its structure, and functionality, is quite distinct from this current design.

Finally, the patent to George, et al., U.S. Pat. No. 6,059,701, shows an apparatus for exercising the lower back. While this device may provide a means for kneeling, as can be seen, as upon a kneeling pad, the stress is exerted through the cylindrical back pad, that provides for tensioning of the back muscles, and not the hamstring group, as can be noted.

It is, therefore, the provision of an exercising device, through the structure of this current invention, that focuses primarily upon tensioning of the hamstring group of muscles, to provide for their strengthening, and prevent their weakening or tearing, particularly when the exerciser is subjected to strenuous activity, such as in sporting events, or the like.

SUMMARY OF THE INVENTION

This invention contemplates the formation of an exercising device that is designed to train the hamstring group of muscles. This is designed primarily for the athlete, and which can be used particularly before an athletic event, but obviously, can be used by anyone wishing to train and strengthen the hamstrings, regardless of participation in whatever event may be planned. As is well known, many of the athletes, such as football players, and runners, pull the hamstring muscles, which can result in a season ending injury. Many athletes attempt to stretch the hamstrings, before a sporting event, and this helps, but there is a need for a specific exercising device where the hamstrings can be continuously exercised, with every practice, and even shortly before game time in order to build up their resistance against damage.

Essentially, this invention is designed to incorporate a stable base, made of various frameworks. To the base there is rigidly fixed a frame, and on top of the frame there is a platform, and upon the platform there is located a knee rest. At the back of the platform is an adjustable pair of padded rollers. Thus, the user will kneel upon the kneeler, and place his ankles or feet under rollers, to provide a stationary hold to the lower legs, while participating upon the exercising machine of this invention.

There is also a vertical framework that is secured into the structure of this device. The vertical framework pivotally mounts upon the supporting framework, as explained. The vertical framework is generally L-shaped, as noted, and on the bottom leg there are supports that hold the various weights that may be applied to it, in order to vary the amount of resistance that can be applied to the muscles, when exercising upon this particular device. As the weights are applied to the bar, the vertical framework has a tendency to pivot forward. In other words, the weights tend to seek the lowest point of gravity. Extending between the vertical frameworks is a chest roller. Thus, when the user kneels upon the kneeler, places his feet under the rollers, he can then pivot the upper part of his torso or body forwardly, for some degree, depending upon the amount of weight located at the bottom of the vertical frameworks, as explained. The user can continue to perform in this manner as the chest comes into contact upon the chest roller. This type of exercise causes a stressing and stretching of the hamstrings, which are in the back of the thighs of the user. Then, as the forwardly pivoted user encounters the chest roller, he/she can then exert a force upon the roller to force the vertical framework to pivot further, entirely into a horizontal position. Repeat performance of the exercise can substantially strengthen and improve the mobility of the hamstrings in order to prevent their tearing, or sustaining other injury during participation in strenuous or other athletic events.

This device has been specifically designed to train the hamstring or knee flexor group of muscles. This group of muscles is often an overlooked and undertrained portion of anyone's training regimen. This device targets and isolates this group of muscles in a way that has not as yet been accomplished through use of traditional type of resistive machines. This unique machine can be a valuable part of any strength and conditioning program for the athlete, regardless whether the athlete is participating in various sports such as track and field, football, soccer, basketball, baseball, volleyball, softball, gymnastics, skiing, as well as power lifting and weightlifting. This particular device is a desirable alternative to other machines being used that try to target the hamstring group, such as the seated leg curl, prone leg curl, or standing leg curl. In its simplest form, this current invention is designed to provide a reverse type of leg curl exercise for the muscles.

The hamstring group of muscles is a very complex combination of muscles, that make up the anatomy in this region of the back of the thighs, and includes muscles in the category of the semitendinosus, semiembranosus, and the long head and short head biceps femoris. The hip muscular anatomy also contributes to the affective functionality of the hamstring group of muscles, which includes involvement from the glutemus maximus at the hip, which acts to extend and externally rotate at the hip joint. Also, involvement from the posterior aspects of the gluteus medius further adds to the functionality of the hamstring group of muscles, in their usage and application.

It is, therefore, the principal object of this invention is to provide a structured apparatus that can focus directly upon toning, strengthening and improving the mobility of the hamstring group of muscles.

Still another object of this invention is to provide a structured device that can function as an exerciser of the hamstring group of muscles and which can be quickly and facilely employed, even just prior to participating in a strenuous athletic event.

These and other objects will become more apparent to those skilled in the art upon review of the summary of the invention as provided herein, and upon undertaking of a study of the description of its preferred embodiment, in view of the drawings.

DESCRIPTION OF THE PREFERRED EMBODIMENT

Figure 2:
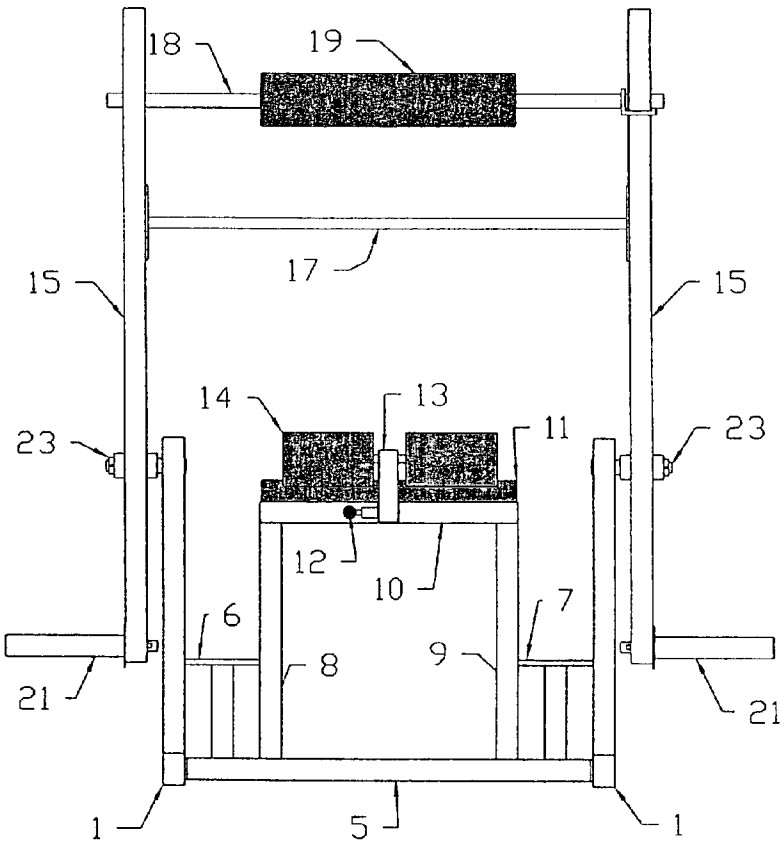
FIG. 2 is a front view thereof.
Figure 1:
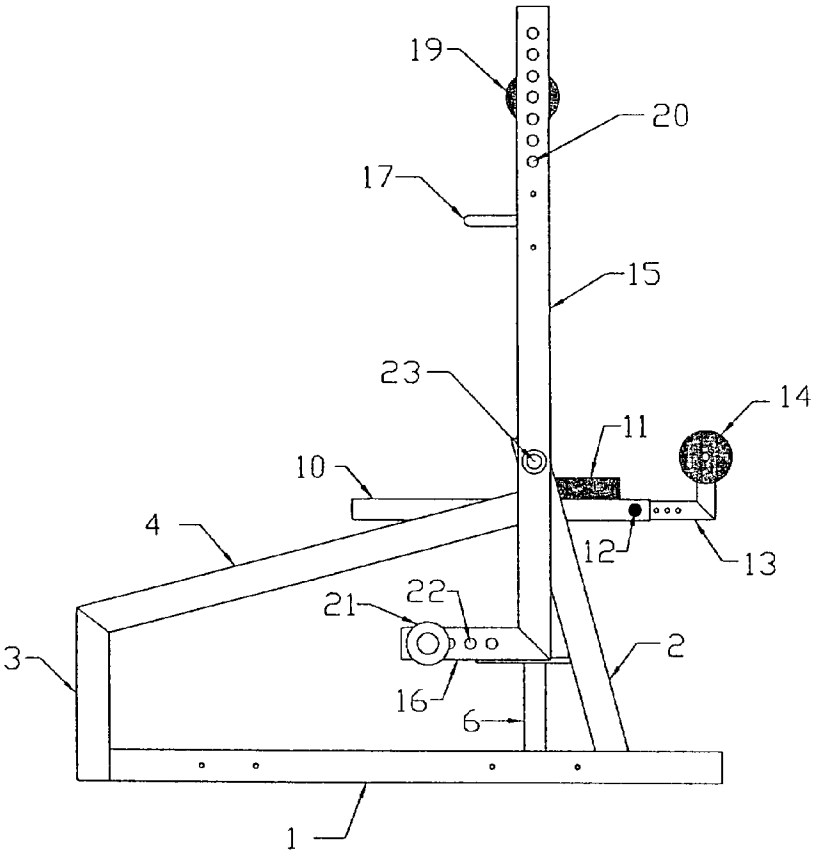
FIG. 1 is a side view of the hamstring exerciser of this invention.
Figure 4:
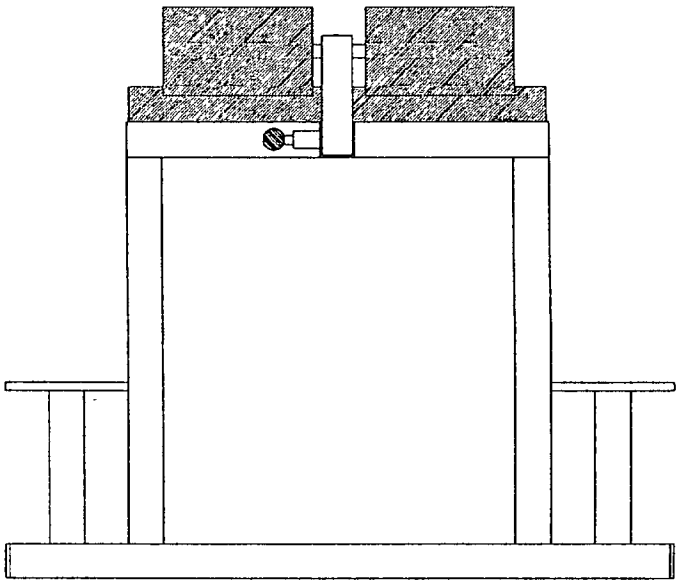
FIG. 4 is a front view of the kneeler and ankle restraint, with further supporting structural components, to that as shown in FIG. 3.
Figure 3:
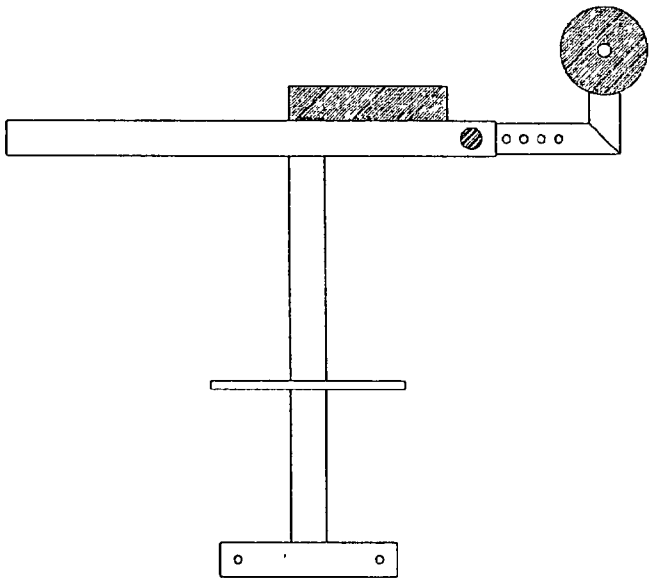
FIG. 3 is a side view of the kneeler and ankle restraint, integrating its supporting structure.
Figure 5:
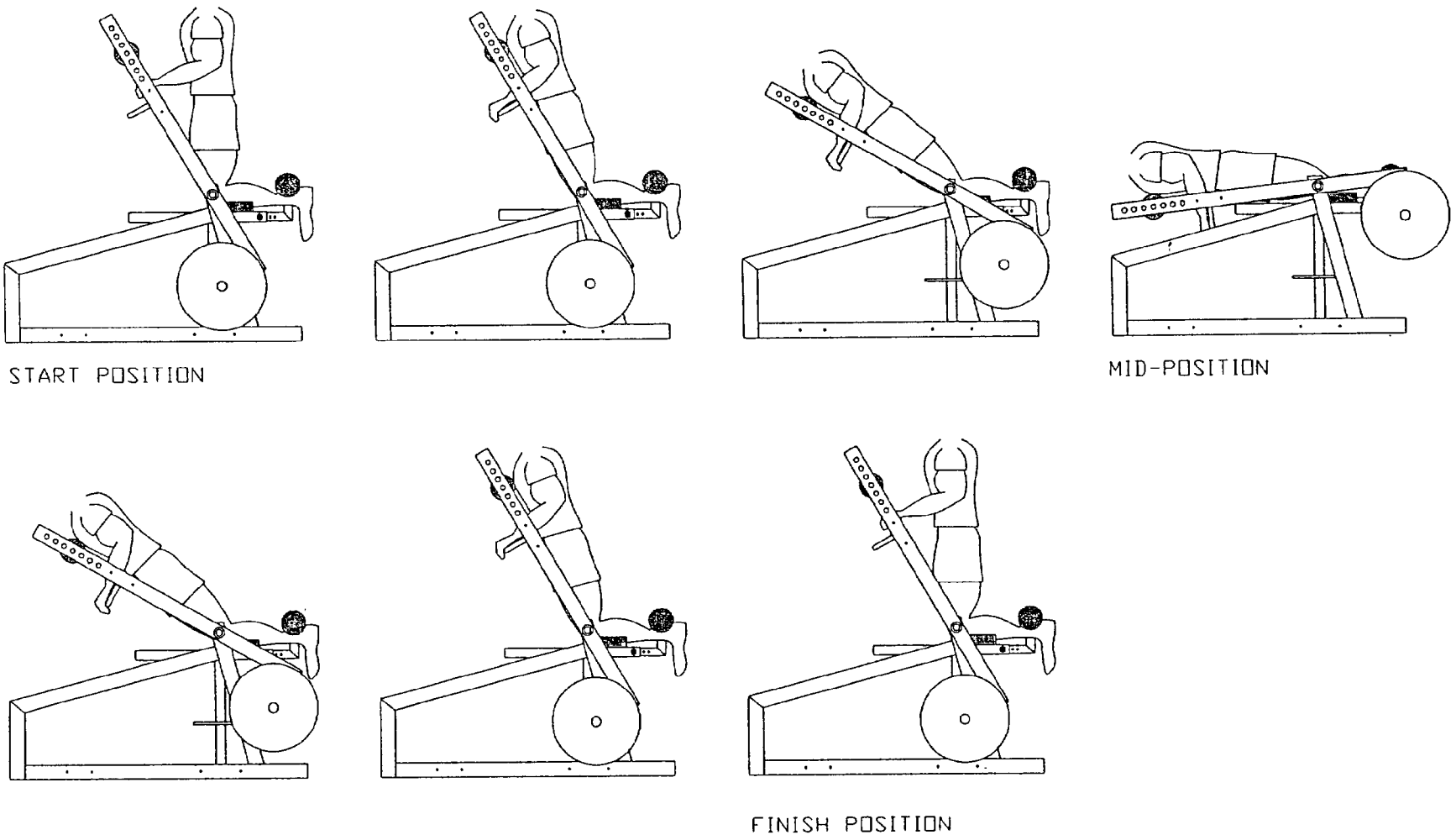
FIG. 5 is a side view of the hamstring exerciser demonstrating the entire motion of the exerciser.

In referring to the drawings, it can be seen that the hamstring exerciser 1 is constructed of a variety of frameworks. In FIGS. 1 and 2, the complete assembly is shown from the front and the side. The framework that is referred to as the base of the exerciser includes a horizontal member 1, vertical frame members 2 and 3, and an inclined upper frame member 4, as can be seen. The base is the support for the operating components of the exercising device. In FIGS. 3 and 4, the inner frame members are shown in detail, which includes a horizontal member 5 and vertical members 6,7,8 and 9. It is by this member 5 that connects the inner frame to the base by securement to base member 1. The vertical members 6 and 7 are used as steps to position the user on the exerciser, as well as, for further reinforcement. The upper end of the inner frames 8 and 9 includes transverse frame 10. It is upon this frame that a kneeling pad 11 secures and which further includes a length adjusting rod 13 that telescopically fits within frame 10 and can be locked into position, by means of a key 12, as noted. The telescoping rod 13 includes a restraining padded roller 14. In FIG. 5, it is shown that it is under this roller that the ankles, or lower portions of the leg, of the user locates, while kneeling upon the pad 11. Thus, the roller 14 restrains the ankles of the user from lifting upwardly, while participating in usage of this hamstring exerciser device. Actually, the ankle restraining means includes a pair of rollers, as can be noted. One ankle and foot of the user locates under one each of the shown padded rollers 14.

A vertical and movable framework 15, pivotally connects about the pivot pins 23 stably secured to the upper ends of the vertical frames 2, as can be seen. The purpose of the vertical member 2, and its entire base, is to provide support for the pivot of the vertical framework 15 about the pivot pins 23, relative to the base. While the user kneels upon the kneeler 11, and while the lower legs are restrained by means of the padded rollers 14.

Spanning transversely between the approximate upper ends of the roller support 18 and upon which a padded roller 19 mounts. Obviously, as can be seen in FIG. 1, the roller support 18 can be adjusted heightwise, by locating it through the variety of apertures 20. A handle bar 17 is also provided spanning the space between the vertical frames 15. The user of the device can hold onto the handle bar 17, eventually rest his/her upper torso or chest against the roller 19 and pivot forwardly, when using the hamstring exerciser.

Figure 6:
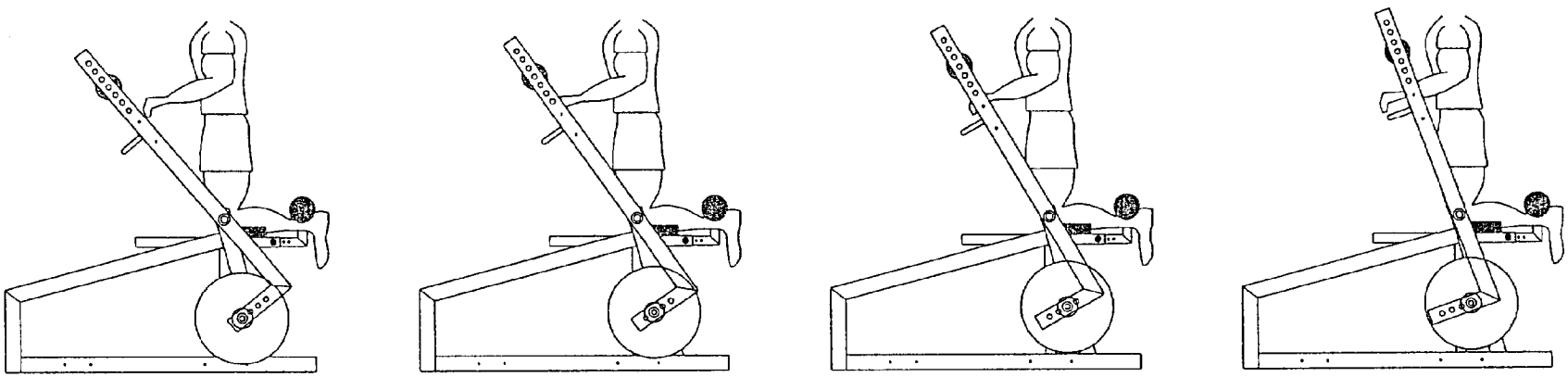
FIG. 6 is a side view of the hamstring exerciser demonstrating the four different starting positions possible.

Extending laterally from the bottom end of the vertical frames 15 and upon their extensions, as shown at 16, are the weight supports 21, as can be noted. Thus, as understood in the exercising arts, various weights may be applied to the weight supports 21, to add further resistance to the forward pivot of the vertical frames. In FIG. 6, it is shown when weights are applied to the weight supports, because of the L-shaped configuration of the frames 15 and 16, the entire framework will pivot, on its own, forwardly, to some degree, as the weights tend to become centered, by gravity, to the lowest point. It can be seen in FIG. 6, that the weight supports 21 can be adjusted away from the pivot pins 23 by locating it through a variety of apertures 22. This is to vary the degree that the vertical frames 15 will pivot forward, which changes the point of contact of roller 19 to the user. This is needed to account for the different strength levels of the users.

This machine is designed to provide assistance at the chest level to allow the user to lower the upper body until a complete horizontal position is achieved and then return to the vertical position or starting position. The vertical framework pivoting about the pivot pin to raise weights that are applied to the weight supports does this. This particular movement is not possible without assistance. This is due to the mass of the upper body.

In FIG. 5, the usage of the hamstring exerciser is shown. The exercise is performed in kneeling position with the knees resting on the kneeling pad. The lower extremity stabilization is provided just proximal to the heels by an adjustable support, comprising the ankle support, as previously explained. In this manner, the lower leg is supported at the knees with the kneeling pad system and at the distal leg portion with the adjustable support ankle rollers. In this position, the hips of the user are in a neutral or vertical alignment. The user will first need to tension the hamstring muscles by pivoting forwardly, without any support, because at that time the upper torso or chest of the exerciser will not have encountered the roller 19, as yet. Again, locating weight supports in the different apertures 22 of the vertical frame extensions 16 can vary this point of contact. The user then continues to lower the upper body until a complete horizontal position is achieved. This is the mid-position. The user then returns to the vertical position, which will be the finish position.

The most important aspect of the exercising machine is the support or spot given at the chest level. The more weight that is added, the greater the assistance to the user. The less weight that is added, the higher the level of difficulty for the user. For example, a larger person, or for one who is not adequately developed, a greater amount of added weight is required. The stronger or lighter the body weight of one is, less weight will be needed during usage. It is recommended one start with a larger amount of weight and decrease until the desired level is achieved. As can be understood, the more the weight, the greater resistance to the upper torso, and therefore, this provides support to the user while lowering into the mid-position. Thus, the resistance lessens with the lesser amount of weights applied to the exercising apparatus, and as result, this requires greater stressing upon the hamstrings, when lowering into the mid-position, than if a greater amount of weight is applied to the device.

Through engineering, this exercising machine has been designed to provide assistance, or isolated type of muscle tensioning, to the user. Due to the biomechanics of normal human movement, the same resistance is not needed throughout the entire movement. As mentioned earlier, placing weights on the weight supports provides the assistance of the device. The actual assistance given to the user increases from the starting position to a mid-position and then returns to a level of assistance needed to complete the movement. The assistance is less in the starting or upright position, and is greater in the mid-position and which further is determined by the amount of weight applied to the machine. The more weight, the less stress will be applied to the hamstrings. To the contrary, lesser weights place more stress on the hamstrings as the body lowers into the mid-position, as can be understood.

Unlike other machines, torso stability is needed during this exercise. Stability is generated by use of the abdominal, gluteal and lumbar musculature. This stability is needed to keep the user in an upright position through the entire motion. Performance in this position will train many muscle groups simultaneously. The kneeling position is not considered a resting position, as is the sitting or prone position, during exercising. Also, the anterior thigh is not rested on a pad such as when one is performing the movement in a prone or standing unilateral position.

Generation of the stabilization of the trunk is very important to athletics. Strong abdominal, gluteal and lumbar musculature is vital to ensure proper trunk control and proprioception as well as stabilizing the spine. Developing this core stabilization may prevent injuries to the extremities as well. Performing the movement of knee flexation and extension in this kneeling position makes the exercising device much more functional in nature and more valuable to athletic type movements.

Unlike other methods currently being used to train the hamstring group of muscles, the exerciser of this invention involves an eccentric movement followed by a concentric movement. The eccentric movement is the lengthening of the muscles and the concentric movement is the shortening of the muscles. When using the exerciser device of this invention, the hamstring group acts eccentrically from the starting upright position and in that position the group of muscles decelerates the upper body to the mid-position. Without the assistance at chest level, as provided by the weights, this movement is almost entirely impossible. At the mid-position, the hamstrings are fully lengthened. This lengthening or eccentric expansion is followed by an immediate concentric contraction or shortening of the hamstring group. This concentric contraction produces a force to bring the user back to the upright position. Thus, as can be understood, exercising upon this device involves a shifting from the upright to the prone position, and back, repeatedly, when exercising the hamstring group of muscles. See FIG. 5.

Nearly all of the resistance machines on the market including those used for upper extremities are designed to have the user perform a concentric movement first, followed by the eccentric movement. Again, the seated leg curl and prone leg curl are performed in this manner. From the lengthened position, the user curls the weight until a position of active insufficiency is achieved. Active insufficiency is defined as an inability to generate tension in the muscle because the muscle is in a sense too short. The weight is then lowered to the resting position.

This exerciser is used in the performance in a manner just opposite to this. The movement is initiated with the lengthening stage and then the shortening stage, which not only makes the movement much more difficult, but much more functional, as well. Virtually all athletic and daily activities are performed in this manner. In general movements, such as jumping, kicking, throwing, hitting, and sprinting are performed in this manner. Since our body functions in this manner, athletes should be directed to training in this manner as well. Finally, this machine has been designed to simulate this type of movement for the hamstrings.

By way of example, there are very important advantages to eccentric training. The strengthening of the hamstring group will provide stabilization of the knee and prevent anterior shift of the tibia. Strong hamstrings will also prevent hypertension of the knee. An increase in eccentric strength will enable the hamstrings to generate increased tension at a higher velocity of contraction, which may prevent injury. In addition to those mentioned earlier, there are two other possible effects of eccentric training. First, stretching, with a lengthening of the muscle tendon unit occurring, leading towards less strain during motion. Second, loading within the muscle tendon unit, which leads toward hypertrophy and subsequent increased tensile strength.

This ability to generate tension eccentrically could lead to prevention of many hamstring injuries occurring in athletes. Many theories have been proposed as to why athletes are sustaining hamstring injuries. It has been proposed that one possibility is that the quadricep muscle group is disproportionate in strength in that it is much stronger than the hamstring group. The quadricep group is responsible for extending the knee. On average, the hamstring to quadricep strength ratio should be approximately 67%. In many cases this ratio in athletes is much lower making them possible candidates for knee complications. Many strength programs are designed to constantly train the quadricep group with less attention given to the vital hamstring group. One reason for this is the lack of training methods being used for the hamstring group. With this invention, parity can be provided to the exercising of the hamstring group, as can be understood.

In terms of hamstring injury related to running, two ideas have been proposed. Normal gait and running consists of various stages divided amongst movement patterns of the lower extremity. Of those stages, the hamstrings are responsible in the later stages of swing, prior to foot strike, in preparation of the lower extremity coming into contact with the ground. The roll of the hamstring is to slow the lower leg from a flex to an extended position. Here the hamstring is acting eccentrically, similar to training with this exercising device. Working against the hamstring is the powerful contraction of the quadricep which produces knee extension. If the hamstrings are unable to slow the over-striding of the lower leg, injury to the hamstring may occur. This inability to slow the lower leg may be due to insufficient tension production by the hamstring. It has also been proposed that upon contact with the ground, the hamstring may fail due to improper positioning of the foot in an excessive forward position. Failure is due to the inability of the hamstring to develop tension at foot strike.

Thus, the use of this exercising device for providing for stretching and loading of the hamstring can provide for strengthening of these muscles to add parity to that of the other aligned muscles, such as the quadriceps, as previously explained. Thus, the incidence of injury to the hamstrings may be significantly reduced by isolating the exercise of this invention directed towards the hamstring group of muscles.

Figure 7:
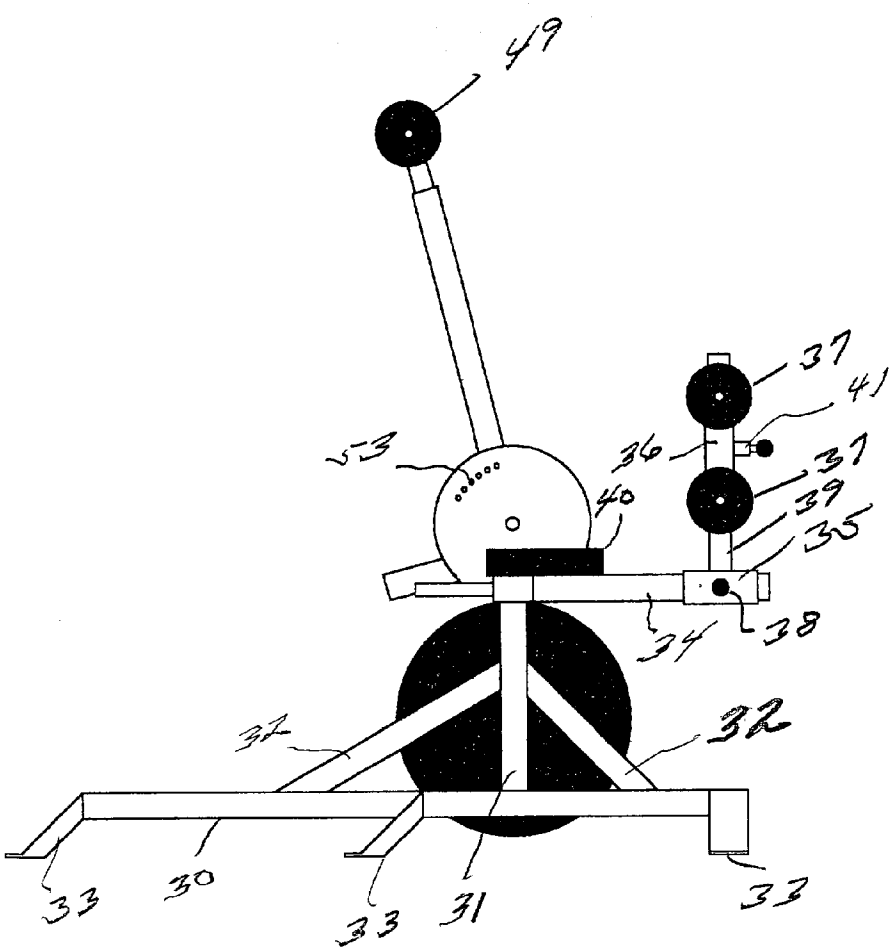
FIG. 7 shows a modification to the hamstring exerciser of this invention, utilizing a single weight mount for varying the resistance of the exercise machine during usage.

FIG. 7 shows a modification to the exercise machine of this invention. As disclosed, it likewise includes a base incorporating a horizontal member 30 and which includes a vertical frame 31 secured to the horizontal frame by a series of brace members 32, as noted. Various mounts 33 stabilize the horizontal member 30, when the machine is set up for usage.

Mounted to the upper end of the vertical frame member 31 is a rearward frame 34 and adjustably mounted onto the rearward frame is a sleeve 35, that further mounts thereon a sleeve 36 to which a pair of ankle bracing rollers 37 are rotatably mounted thereto. It is to be noted that an adjustment knob 38 adjustably secures the member 39, and its sleeve 35, to the transverse frame member 34. Thus, the distance of the ankle rollers 37, from the knee pad 40 can be varied. Likewise, the elevation of the sleeve 36, and its rollers 37, are held by an adjustment knob 41 to the frame 39, so as to raise or lower the location of the rollers 37, with respect thereto, and thereby vary the stress experienced during exercising.

Figure 8:
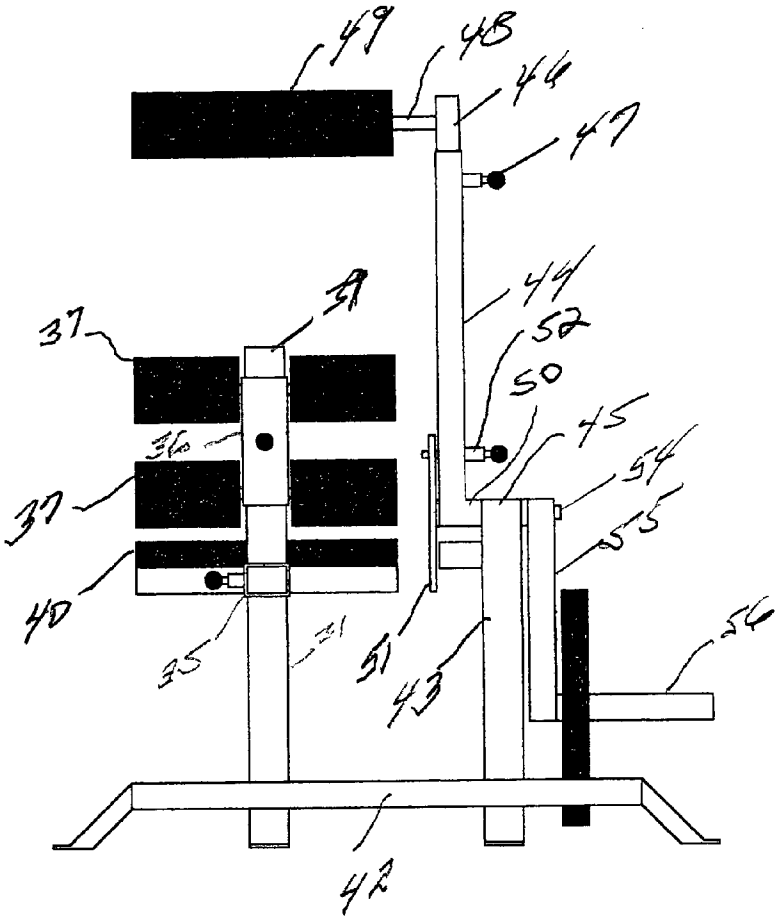
FIG. 8 is a back view of the hamstring exerciser of FIG. 7.

As can be seen in FIG. 8, also extending upwardly from the horizontal and transverse frames 30 and 42 is a further vertical frame member 43, and which is secured stably thereto. Pivotally mounted to the upper end of the frame 43 is a moveable framework 44 being pivoted at 45 to said frame 43. Telescoped within the upper end of the moveable framework 44 is a member 46, being adjustably set relative thereto by means of the adjustment knob 47. A shaft 48 extends laterally from the member 46, and a roller 49 is mounted thereto, and which functions as a padded chest supporting roller, as can be understood. As can be noted, the chest roller 49 is in line with the ankle supporting rollers 37, in addition to the knee pad 40, so that when the user has located himself/herself onto the exercise machine, all of the various pads and rollers will be aligned, to facilitate usage and application of this invention.

Also affixed to the lateral shaft 54 is an adjustment plate 51, and through usage of the adjustment knob 52 the moveable framework 44 can be set, at various angular relationships, relative to the weight supporting means, as can also be seen through the arrangement of the various adjustment slots, as at 53, provided upon the adjustment plate 51, as noted. Actually, the plate 51 is supported on its own lateral shaft 54, and extends through the shaft 50, and shaft 54, mounting the plate 51 at one end, and securing the weight shaft 55 at its other end. Thus, the moveable framework 44 can be pivoted and readjusted relative to the plate 51, which changes the angulation between the moveable framework 44, and the angular relationship of the weight shaft 55, as fixed to the end of the shaft 54. The weight shaft 55 extends downwardly, and includes a laterally extending weight supporting shaft 56, to which various weights, of relative size and poundage, can be added, to either add to or subtract from the amount of resistance afforded by the exercising machine, as the exerciser moves and pivots the upper torso forwardly, when pivoting the apparatus to a more inclined position, thereby stressing the hamstring group of muscles, and likewise, when pivoting back upwardly, to add additional resistance and stretching to the hamstrings, during usage of this exercising machine.

Figure 9:
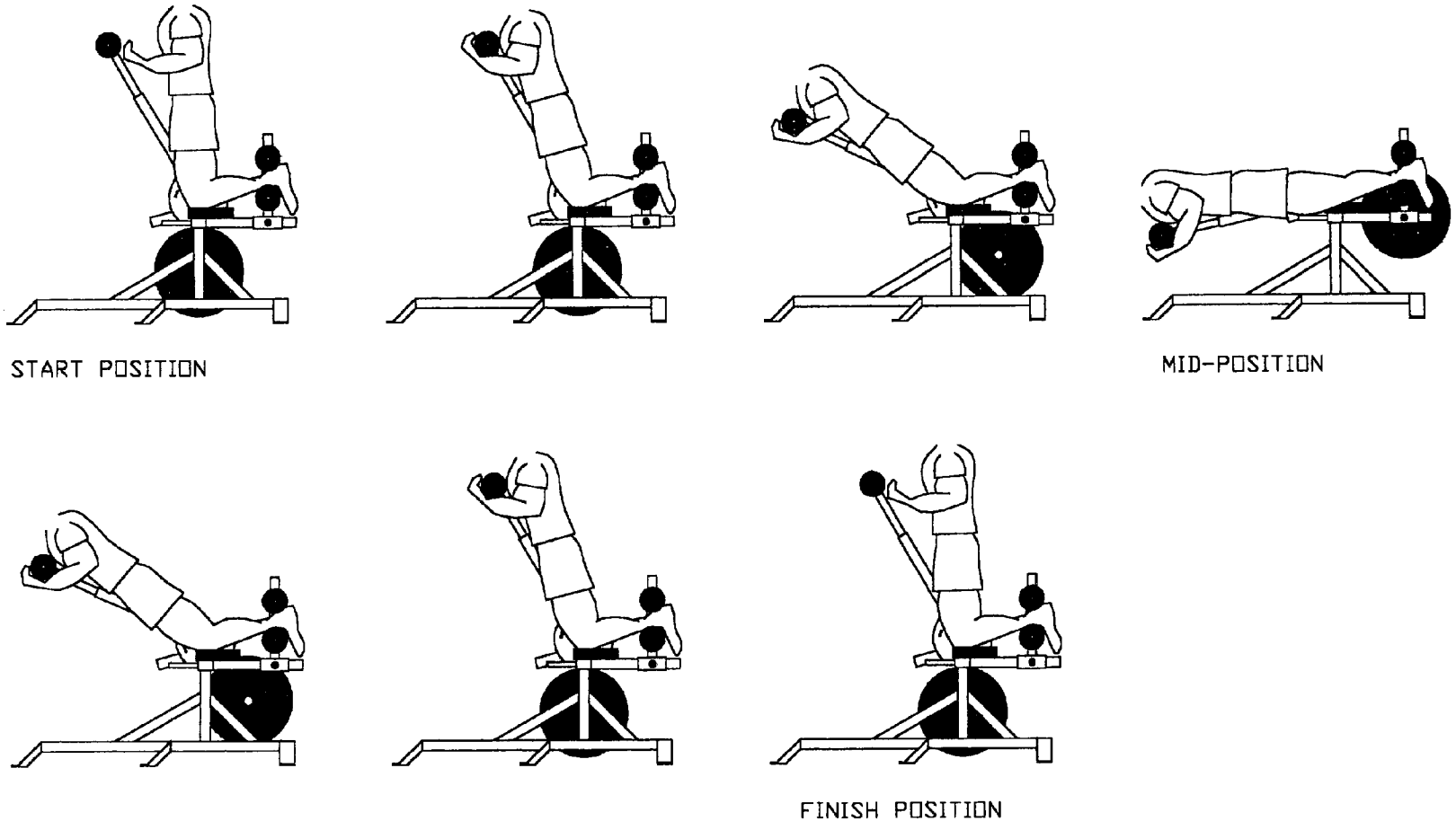
FIG. 9 provides a side view of the hamstring exerciser demonstrating the various position of the user during its application.

FIG. 9 discloses the various positions of the exercise machine, during usage, from its start position, to its mid-position, and back to its finish position, all for use in stretching and tensioning the hamstring group of muscles, as during usage. It is the combination of the knee pads, and the weighted pivotal member against which the chest of the exerciser rests, during manipulation of the machine between the vertical, prone, or finished positions, as can be understood.

Variations or modifications to the invention and its various components, as described herein may occur to those skilled in the art upon reviewing this development. Such variations, if within the scope of this development is intended to be encompassed within the spirit of the invention as described herein. The description of the preferred embodiment, as set forth in the drawings, is provided for illustrative purposes only.

The invention claimed is:

1. An exercise machine to train the hamstring group of muscles, said machine comprising:

a base, said base being formed of a plurality of frame members and provided for resting upon the ground or other level surface, said plurality of frame members including a pair of upright frame members, each upright frame member having an upper end;

a knee rest spanning a space between said upright frame members;

said plurality of frame members including rearward extensions, said rearward extensions having a horizontally adjustable rearward frame located at a position above said knee rest, whereby the user kneels upon the knee rest and locates his/her ankles under the rearward frame;

a vertical framework, said vertical framework being pivotally mounted to the upright frame members, said vertical framework including a pair of side frameworks;

a chest support spanning between the pair of side frameworks, and provided for encountering by the chest of the user during exercising;

an end of said framework the opposite to the chest support incorporating a support for holding select weights, whereby upon the addition of weights to the weight support, the exerciser may incline forwardly upon the machine while his/her ankles are held by the rearward frame and pivot forwardly to provide stretching of the hamstring group of muscles during exercising.

2. The exercise machine of claim 1 wherein the exerciser, upon reverse pivoting to an erect position, further stretches the hamstring group of muscles during continuing exercising.

3. The exercise machine of claim 2 wherein the ankle rearward frame includes a roller.

4. The exercise machine of claim 3 wherein the roller is a padded roller.

5. The exercise machine of claim 2 wherein the chest support includes a roller.

6. The exercise machine of claim 5 wherein the chest support roller is a padded roller.

7. The exercise machine of claim 5 wherein the chest support is adjustable in its height upon the vertical framework.

8. The exercise machine of claim 2 wherein the knee rest comprises a padded knee rest.

9. The exercise machine of claim 3 wherein the ankle roller is adjustable through manipulation of its rearward frame.

10. The exercise machine of claim 2 wherein the vertical framework includes an L-shaped frame, said L-shaped frame having a lengthy segment and a shortened segment, the shortened segment being at the bottom of the L-shaped frame, the lengthy segment extending substantially vertically, in its steady state, and having the chest brace extending therebetween, the short segment of the L-shaped frame having a mount thereon for attachment of variable weights to regulate the resistance to the exerciser while operating upon the exercise machine.

11. The exercise machine of claim 10 wherein the weight mounts extend from the bottom of each L-shaped frame of the vertical framework and therein accommodating the addition of select weights to regulate the degree of stress exerted by the user when operating upon the exercise machine.

12. The exercise machine of claim 11 wherein the mounts for supporting the weights is adjustable upon its short segment of the vertical framework.

13. The exercise machine of claim 2 wherein said base includes a lower frame member for extending along the ground, an upper frame member spaced from the lower frame member, a pair of approximate vertical frame members interconnecting between the lower ground frame member and the upper frame member, and cross braces provided between the frame members to fully integrate the base into a stable structure for supporting the various knee and ankle rests, in addition to the pivotal vertical framework for holding the select weights.

* * * * *